US006234695B1

(12) United States Patent
Freedman et al.

(10) Patent No.: US 6,234,695 B1
(45) Date of Patent: May 22, 2001

(54) VARIABLE POWER THERMAL PRINTER

(75) Inventors: Sharon Corinne Freedman, Morrisville; David Francis Fritz, Raleigh; Robert William Kruppa; Robert Dean Yoder, both of Cary, all of NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/340,092

(22) Filed: Jun. 25, 1999

(51) Int. Cl.[7] ..... B41J 2/315
(52) U.S. Cl. ..... 400/120.01; 400/54; 400/279
(58) Field of Search ..... 400/120.01, 54, 400/279

(56) References Cited

U.S. PATENT DOCUMENTS

| | | | | |
|---|---|---|---|---|
| 4,553,867 | | 11/1985 | Nakai | 400/323 |
| 4,638,333 | | 1/1987 | Feng | 346/76 PH |
| 4,679,053 | | 7/1987 | Katsurai et al. | 346/1.1 |
| 4,834,562 | | 5/1989 | Shikanai et al. | 400/54 |
| 4,933,616 | * | 6/1990 | Changet et al. | 318/561 |
| 5,056,043 | | 10/1991 | Hawkes | 364/519 |
| 5,274,316 | * | 12/1993 | Evans et al. | 318/696 |
| 5,327,165 | | 7/1994 | Elliott | 346/76 PH |
| 5,349,905 | | 9/1994 | Taylor et al. | 101/488 |
| 5,382,101 | | 1/1995 | Iguchi | 400/124.03 |
| 5,524,993 | * | 6/1996 | Durst | 400/279 |
| 5,815,172 | | 9/1998 | Moh | 347/14 |

* cited by examiner

*Primary Examiner*—John S. Hilten
*Assistant Examiner*—Minh H. Chau
(74) *Attorney, Agent, or Firm*—John D. Flynn; Winstead, Sechrest & Minick, LLP

(57) ABSTRACT

A printer using a power reduction logic based upon reducing the speed of printing when the dot utilization calculation exceeds a particular power level for that printer. There is also provided a method for printing information at a given power supply capacity level, comprising the steps of: examining the a group of rows of dots to be printed; calculating the maximum dot utilization value for the group; selecting a print speed based on the maximum dot utilization value; printing the first row of the group of rows; and repeating above steps until the information is printed.

14 Claims, 3 Drawing Sheets

VARIABLE POWER THERMAL PRINTER

TECHNICAL FIELD

The invention relates in general to computer printers, and in particular to thermal dot printers used with point of sale cash registers.

BACKGROUND INFORMATION

Various kinds of dot printers are known in the art. Early so-called "dot matrix" printers employed one or more pins driven forward and backward by a solenoid drive mechanism to transfer ink from a ribbon to the surface of a media as a series of dots or "pixels". This type of printer can be contrasted to laser printers, electrostatic printers, and the like, which form an entire two dimensional area as dots from a "toner" material which is then transferred to the surface of the media and fused to the surface by the application of heat. While mechanical dot matrix printers are still used in some applications, modern dot printers are more likely to employ a thermal inline printhead, a thermal printhead or an inkjet printhead.

Typically, an inline thermal printhead includes a plurality of print positions arranged in a horizontal line across the entire width of the print area. Each print position has a heating element connected to wires. When power is applied to the wires, the heating element increases in temperature. At a certain temperature, the heating element causes a visible dot to appear on the media being printed when employing thermal direct techniques where the heat is applied to a heat-sensitive coating on the surface of the media, or, where ink is transferred from a thermally sensitive ribbon to form a dot on the surface of the media.

The size and shape of the dot is a function of the shape of the heating element, temperature of the heating element and the length of time the element is applied to the medium or ribbon. As the heating elements retain heat from previous printing operations and adjacent elements, the quiescent temperature of the heating elements rise.

When using a conventional thermal printer, the heating elements are selectively heated to form a line of dots which are a linear portion of the characters comprising the row of information to be printed. Once the line of dots is printed, the media advances so that another line of dots can be printed as the process is repeated. The characters in the row are simultaneously formed as a predetermined number of rows of dots are printed.

A drive system comprising a stepper motor and a system of gears and rollers advances the media a predetermined distance along a paper path such that another row of dots can be printed. This process is repeated until the entire row of characters or "print line" is printed on the media. After the print line is printed, the paper is advanced so that another print line can be printed as the process is repeated.

The power required to print a row of dots is a function of the number of print elements that are powered for a given row. The higher the number of print elements powered, the higher the current required from a given power supply. This is known in the art as dot utilization or the number of dots printed for a given row. As an example, the dot utilization of a Point-of-Sale (POS) printer printing normal text averages below thirty percent (30%). On the other hand, printing logos can result in dot utilizations up to one hundred percent (100%) or totally black printing across the media.

The power required for the printing operation is also a function of the printer motor. Stepper motors are widely used in computer printers because they have accurate position control and are compatible with digital systems. Electrical pulses of suitable amplitude and pulse width are supplied to the stepper motor to advance the motor by a predetermined distance for each pulse. One advantage of stepper motors is that the motor position can be determined by counting the pulses applied to it. Stepper motors have a torque-speed characteristic wherein torque decreases as speed increases. Stepper motor acceleration and deceleration times have been undesirably long due in part to the nature of the available torque characteristic of the motor. In an attempt to counteract this problem, stepper motors are accelerated and decelerated in accordance with a predetermined velocity profile, or velocity variation as a function of time. The corresponding graph is known by those in the art as a "ramp" curve. The ramp curve for a particular motor can be stored in a computer as a series of numbers or "ramp table."

Ramp tables are used to vary the stepper motor's speed. They usually involve the assumption that the motor velocity will follow a particular mathematical function, such as a straight line (constant acceleration) or a parabola (very low acceleration at peak speed). Ramp down curves can also be generated empirically. The procedures for generating ramp down curves and the routines for incorporating such curves into the printer's microcode are well known by those who practice the art. One such procedure is described in U.S. Pat. No. 5,274,316, issued on Dec. 28, 1993 to Evans.

Point of Sale (POS) computer terminals and other commercial applications typically use thermal printers for printing sales receipts and other documentation. Often printers used in these applications are attached to the POS terminal and the POS terminal supplies power to the thermal printer. Due to obsolescence and maintenance, it is often necessary to replace the thermal printer without replacing the entire POS terminal. As the technology has been able to offer better quality and increased flexibility, the power necessary to run newer printers has also increased. Unfortunately, the power supplies in most existing POS terminals were designed for older printers that do not have the relatively high power requirements of newer printers.

It is possible to reduce the speed of the printer, and thereby, reduce the power required for printing due to a lower printing duty cycle. However, if the dot utilization is low, reducing the speed needlessly slows down the entire printing operation.

What is needed, therefore, is a printer that can look ahead to determine the power requirements for a given block of information to be printed. If necessary, power requirements can be maintained at a given level as the dot utilization percentage increases or power requirements can be reduced for a given block of information to be printed.

SUMMARY OF THE INVENTION

The previously mentioned needs are fulfilled with the present invention. Accordingly, there is provided, in a printer having a printhead, drive system, a power supply with a set power level, and a print logic for scanning a block of information to be printed to determine the maximum dot utilization for the block. The speed of the printer is then adjusted based on a given dot utilization such that the power requirements of printing the block of information do not exceed the set power level.

There is also provided a method for printing information at a given level, including the steps of examining a group of information to be printed, calculating the maximum dot utilization value for the group, selecting a print speed based on the maximum dot utilization value, printing information at the calculated speed, and repeating the foregoing steps until all of the information is printed.

These and other features, and advantages, will be more clearly understood from the following detailed description taken in conjunction with the accompanying drawings. It is important to note the drawings are not intended to represent the only form of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
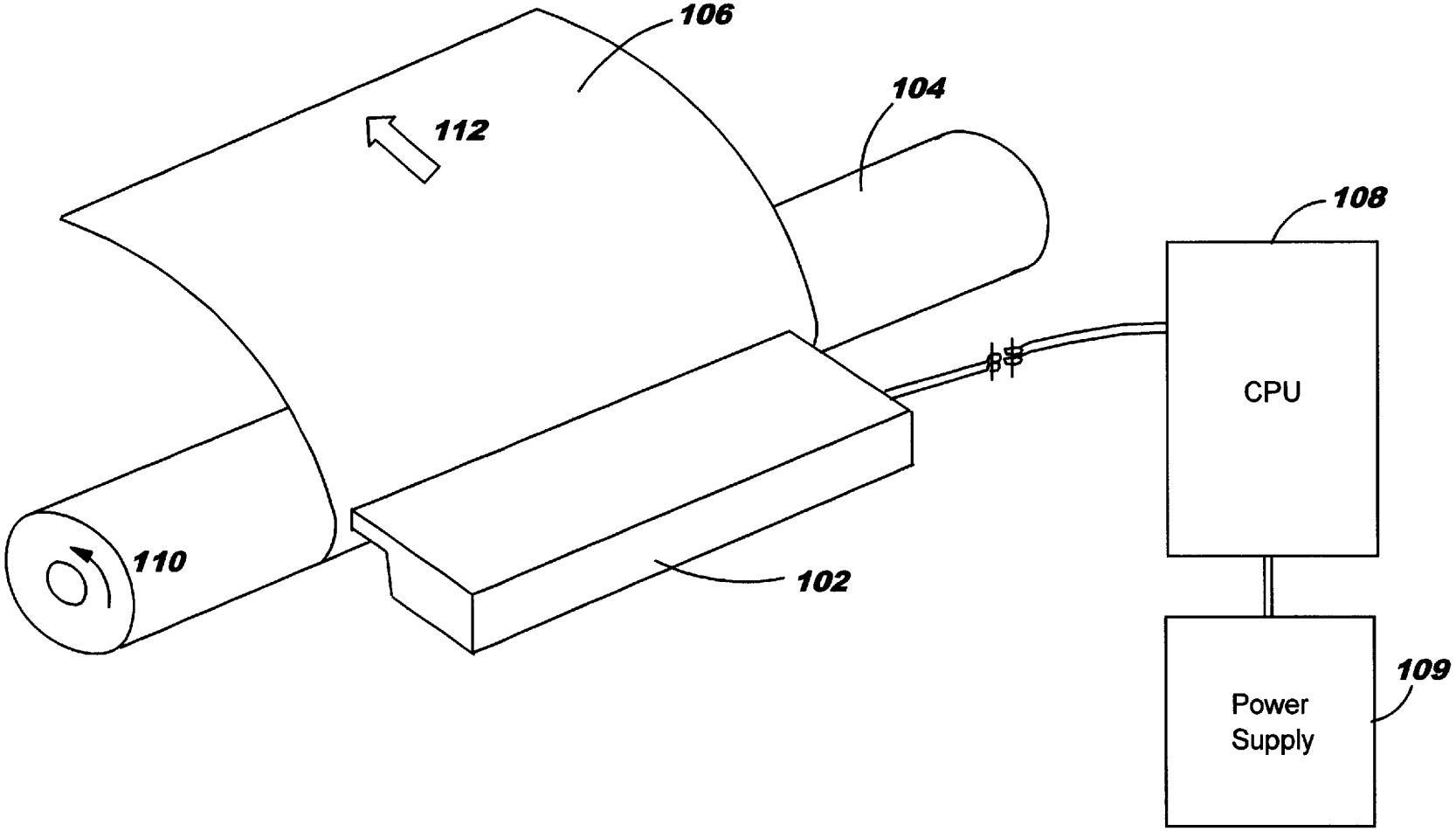
FIG. 1 is a schematic view of a thermal recording apparatus in which an embodiment of the present invention is applicable.
Figure 2:
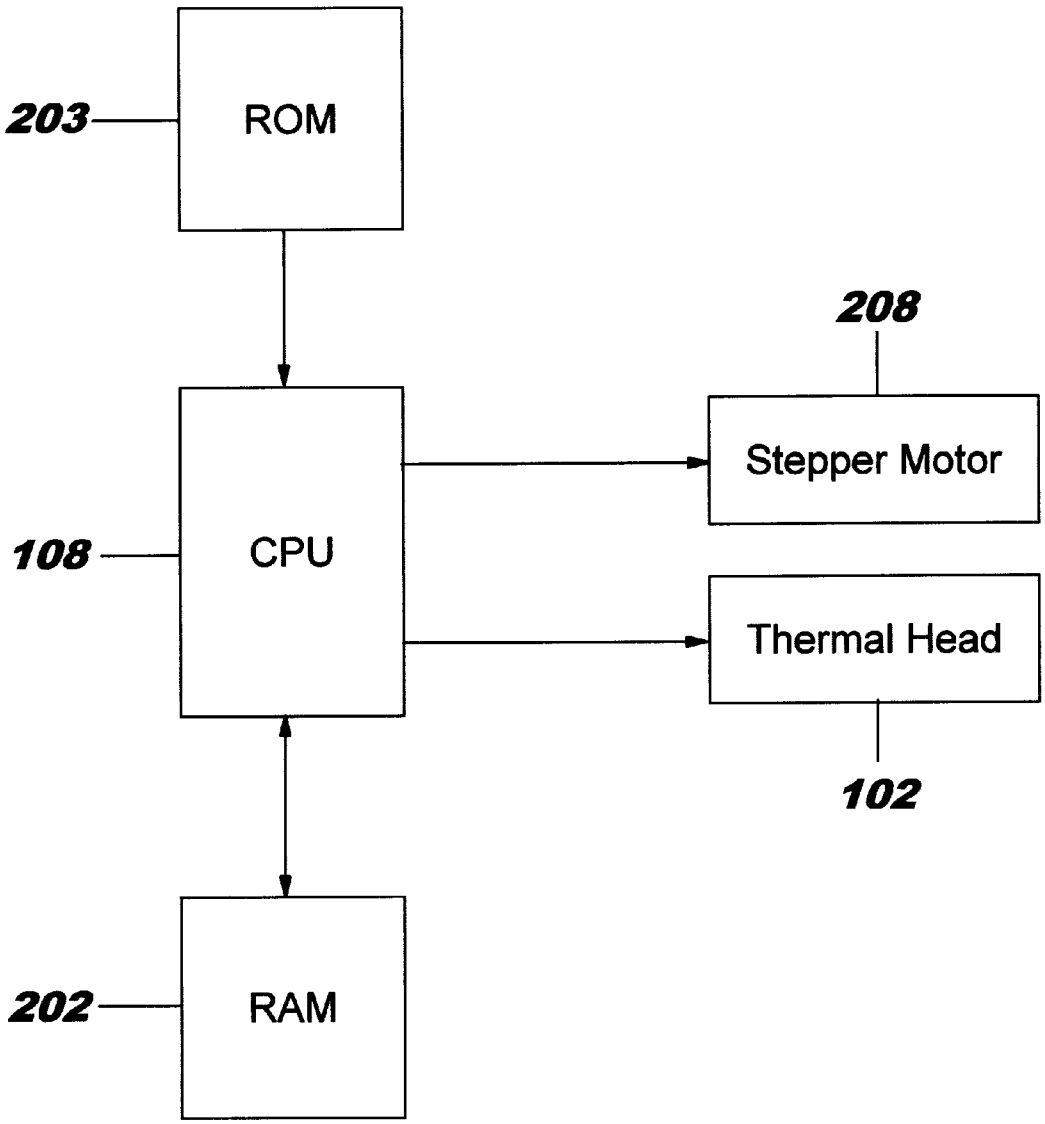
FIG. 2 is a block diagram showing a thermal printer according to an embodiment of the present invention.
Figure 3:
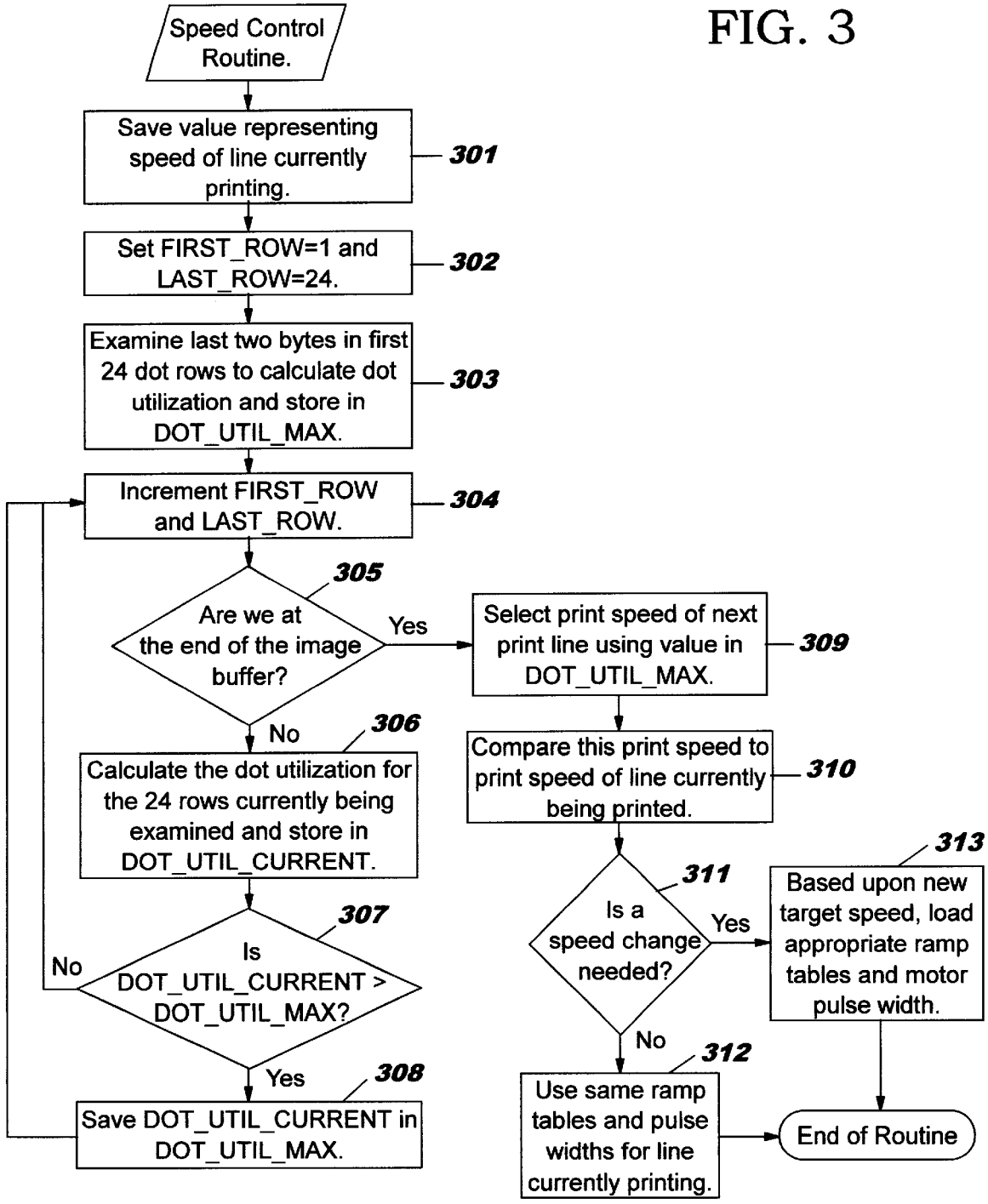
FIG. 3 is a flow chart showing the control sequence and print logic for one embodiment of the present invention.

The principles of the present invention and its advantages are best understood by referring to the illustrated embodiment depicted in FIGS. 1–3 of the drawings, in which like numbers designate like parts. In the following description, well-known elements are presented without detailed description in order not to obscure the present invention in unnecessary detail. For the most part, details unnecessary to obtain a complete understanding of the present invention have been omitted inasmuch as such details are within the skills of persons of ordinary skill in the relevant art. Details regarding control circuitry or mechanisms used to control the rotation of the various elements described herein are omitted, as such control circuits are within the skills of persons of ordinary skill in the relevant art.

As discussed previously, by varying the print speed (lines printed per second), one can affect the power supply requirements for a given row of dots. A printer microcode algorithm can be developed to "look ahead" to the next row of dots to be printed to determine the dot utilization, then adjust the speed accordingly. For example, a printer might not exceed a given power supply if the print speed is 52 lines per second (lps) and the dot utilization is less than sixty-five percent (65%). As the dot utilization increases over 65%, the print speed is reduced to 35 lps. Finally, at 93% dot utilization, the print speed is further reduced to 26 lps. Printing at these reduced speeds requires less power, and thus, allows the use of older power supplies or power supplies with a power capacity that is below that required at maximum dot utilization and print speed. However, because the higher dot utilization occurs on an infrequent basis, the reduction in speed will have little impact on the overall printing time.

In FIG. 1, an in-line thermal printhead 102 is mounted in such a manner that it can be lowered against a platen roller 104. Thermal printhead 102 consists of a horizontal linear array of numerous heating elements (not shown). The heat generating elements individually generate heat by power supplied by electric power supply 109 and are activated by heating or printing signals from a central processing unit ("CPU") 108. A thermally sensitive recording medium 106, such as recording paper, is supported on platen roller 104. Platen roller 104 is rotated counterclockwise in direction 110 to advance recording medium 106 in succession in a direction 112. A system of gears (not shown), powered by stepper motor 208, rotates platen roller 104.

FIG. 2 shows a block diagram for a thermal printer related to one embodiment of the present invention. CPU 108 controls the printer in accordance with algorithms stored in a preprogrammable memory, such as flash memory or read-only memory ("ROM") 203. Data from the keyboard (not shown), another CPU, or another source is processed by CPU 108 and sent to the printer. The processed data is temporarily stored in random access memory ("RAM") 202. Then, in response to a printing command entered on a keyboard or another CPU, CPU 108 reads the text data from RAM 202 and executes a character pattern routine stored in ROM 203 to generate the text data. The character pattern contains predetermined row and column dot locations for each character or symbol. ROM 203 also contains a speed control routine to control the print speed. If flash memory is used in place of ROM 203, predefined messages and symbols can also be printed at the direction of a application program running on the host computer. As printing starts, CPU 108 continuously outputs each horizontal array of dots of the character patterns to thermal printhead 102. Thermal printhead 102 has dot heating elements so that it may selectively pass current through the dot heating elements corresponding to the horizontal array of data. CPU 108 coordinates the velocity of stepper motor 208 with the selective heating of the horizontal array of dot heating elements so that platen roller 104 moves a predetermined amount in relation to thermal printhead 102. Consequently, a new horizontal array of information can be printed on recording medium 106 (FIG. 1).

The speed control routine operates according to the flow diagram shown in FIG. 3. In response to a printing command as a result of data stored in RAM 202, selected heating elements are powered in thermal printhead 102 to print a line of data or symbols. A line of data represents approximately 24 rows of dots or "dot rows". The speed of printing for the current row of dots is saved in RAM 202 (step 301). A variable in memory, FIRST_ROW, is set to 1, and a second variable in memory, LAST_ROW, is set to 24 (step 302) to represent the first 24 dot rows in the image buffer. The image buffer is that portion of RAM 202 used to store the information just before it is printed. The dot line utilization is calculated for the first 24 dot rows of the image buffer. This value is stored in variable DOT_UTIL_MAX (step 303). The routine then enters a continuous loop where the variables FIRST_ROW and LAST_ROW are incremented by one (step 304) each time the step is performed. The first step in the loop is a decision step to determine if the end of the image buffer has been reached (step 305). If not, the dot utilization is calculated and stored in variable DOT_UTIL_CURRENT for the current 24 rows being examined (i.e., the rows between LAST_ROW and FIRST_ROW) (step 306). The next decision step compares the current dot line utilization value in variable DOT_UTIL_CURRENT to the maximum dot utilization value in variable DOT_UTIL_MAX. If the current dot line utilization in DOT_UTIL_CURRENT is greater than the current value of the maximum utilization variable DOT_UTIL_MAX (step 307), DOT_UTIL_MAX is set to the value in DOT_UTIL_CURRENT (step 308). The procedure then returns to the beginning of the loop (step 304). In other words, the procedure scans the dot utilization value of each row before the entire group of rows are printed.

When the end of the image buffer is reached (step 305), the new print speed for the next print line is computed based on the dot utilization value stored in variable DOT_UTIL_MAX (step 309). This value represents the maximum dot utilization required to print the next print line. The new print speed is compared to the current print speed (step 310). If the new speed is within a predetermined increment, no adjustments will be made to the actual print speed of the next line printed (step 312). If the new speed is outside of a predetermined increment, new ramp tables are loaded, along with a new motor pulse width, to calculate a new target speed (step 313). New speed instructions are then sent by CPU 108 to stepper motor 208 and the print heads. Programming such speed instructions is well known by those who practice the relevant art.

A choice of several ramp tables is available for use in programming the speed instructions-from maximum speed to minimum speed. Different tables can accommodate power supplies of different capacities. For example, when using a power supply of low capacity, a ramp table reflecting a rapid reduction of printing speed as dot utilization increases should be used. On the other hand, when using a power supply of a relatively high capacity, a ramp table reflecting a slower reduction of printing speed should be used. However, which ramp table to use is user selectable. Therefore, printing performance may be optimized for the available power supplies.

Operating variable speeds based on dot utilization allows for maximizing the print speed for a power supply of given capacity. The high dot utilization areas of printing occurs in a small percentage of the overall printed receipt, thus this reduction in printing speed has only a minor effect on the total printing time.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It is therefore, contemplated that the claims will cover any such modifications or embodiments that fall within the true scope of the invention.

What is claimed is:

1. A printer, comprising:

a printhead adaptable for printing a plurality of symbols on a recording medium surface as a series of dots at a variable print speed;

a drive system for creating relative movement in a direction of printing movement between said printhead and said recording medium;

a power supply to supply electricity at a set power level to said printhead and drive system; and a print logic for outputting symbol print signals to said printhead and including logic for determining a dot line utilization value by scanning a plurality of rows of dots to be printed and determining a dot utilization value for each row of said plurality of dots and setting said dot line utilization value to be the maximum dot line utilization value, and to adjust said print speed based on said maximum dot line utilization value.

2. The printer of claim 1, wherein said printhead is an inline thermal printhead.

3. The printer of claim 1, wherein said print logic further comprises a firmware routine for selecting a ramp table.

4. The printer of claim 3, wherein said firmware routine includes a means for adjusting said print speed based on said ramp table.

5. A logic system for use in printers for reducing the power required to print characters to a specified power level, comprising:

logic circuitry for outputting symbol print signals to a printhead and including logic circuitry for determining a dot line utilization value by scanning a plurality of rows of dots to be printed and determining a dot utilization value for each row of said plurality of dots and setting said dot line utilization value to be the maximum dot line utilization value, and to adjust said print speed based on said maximum dot line utilization value.

6. The system of claim 5, wherein said print logic circuitry further comprises a firmware routine for selecting a ramp table.

7. The system of claim 6, wherein said print logic circuitry further comprises a means for adjusting said print speed based on said ramp table.

8. A printer, comprising:

a printhead having a series of dot printing elements;

a random access memory for storing information to be printed;

a power supply for supplying electric power at a given power level;

a digital memory containing instructions for a motor and a speed reduction print logic determining a dot line utilization value by scanning a plurality of rows of dots to be printed and determining a dot utilization value for each row of said plurality of dots and setting said dot line utilization value to be the maximum dot line utilization value, and to adjust said print speed based on said maximum dot line utilization value; and a central processing unit capable of reading said information from said random access memory and reading said instructions and said symbol print logic from said digital memory and sending said print signals to said dot printing elements and said motor.

9. The printer of claim 8, wherein said printhead is an inline thermal printhead.

10. The printer of claim 8, further comprising a platen roller.

11. The printer of claim 10, further comprising a drive system for rotating said platen roller such that relative movement in a direction of printing is created between said printhead and a recording medium.

12. A printer, comprising:

an inline thermal printhead adaptable for printing a plurality of symbols on a recording medium surface as a series of dots at a variable print speed;

a drive system for creating relative movement in a direction of printing movement between said printhead and said recording medium;

a power supply to supply electricity at a set power level to said printhead and drive system; and a print logic for outputting symbol print signals to said printhead and including logic for determining a dot line utilization value by scanning a plurality of rows of dots to be printed and determining a dot utilization value for each row of said plurality of dots and setting said dot line utilization value to be the maximum dot line utilization value, and to adjust said print speed based on said maximum dot line utilization value.

13. The printer of claim 12, wherein said printhead is an inline thermal printhead.

14. The printer of claim 12, wherein said print logic includes a means for selecting a ramp table and adjusting said print speed based on said ramp table.

* * * * *